US008551575B1

(12) United States Patent
Li et al.

(10) Patent No.: US 8,551,575 B1
(45) Date of Patent: Oct. 8, 2013

(54) METHODS AND SOLUTIONS FOR PREVENTING THE FORMATION OF METAL PARTICULATE DEFECT MATTER UPON A SUBSTRATE AFTER A PLATING PROCESS

(75) Inventors: Shijian Li, San Jose, CA (US); Artur K. Kolics, Dublin, CA (US); Tiruchirapalli N. Arunagiri, Newark, CA (US)

(73) Assignee: Lam Research, Fremont, CA (US)

( * ) Notice: Subject to any disclaimer, the term of this patent is extended or adjusted under 35 U.S.C. 154(b) by 0 days.

(21) Appl. No.: 13/401,244

(22) Filed: Feb. 21, 2012

Related U.S. Application Data

(62) Division of application No. 12/206,509, filed on Sep. 8, 2008, now abandoned.

(51) Int. Cl.
*C23C 18/16* (2006.01)
*C23C 18/50* (2006.01)

(52) U.S. Cl.
CPC ..... *C23C 18/50* (2013.01)
USPC ..... 427/443.1; 427/443.2

(58) Field of Classification Search
USPC ..... 427/443.1, 443.2
See application file for complete search history.

(56) References Cited

U.S. PATENT DOCUMENTS

| | | | | |
|---|---|---|---|---|
| 3,857,733 | A * | 12/1974 | Arnold | 427/438 |
| 4,239,661 | A | 12/1980 | Muraoka et al. | |
| 4,717,591 | A * | 1/1988 | Acosta et al. | 427/96.2 |
| 5,290,361 | A | 3/1994 | Hayashida et al. | |
| 5,637,151 | A | 6/1997 | Schulz | |
| 6,646,345 | B2 * | 11/2003 | Sambucetti et al. | 257/748 |
| 7,008,979 | B2 | 3/2006 | Schottman et al. | |
| 7,399,365 | B2 | 7/2008 | Aoyama et al. | |
| 7,465,358 | B2 * | 12/2008 | Weidman et al. | 118/667 |
| 2002/0040852 | A1 | 4/2002 | Barber et al. | |
| 2003/0181332 | A1 | 9/2003 | Sedun et al. | |

(Continued)

FOREIGN PATENT DOCUMENTS

| | | |
|---|---|---|
| CN | 1786281 | 6/2006 |
| CN | 101235255 | 8/2008 |
| JP | 2007-246980 | 9/2007 |

(Continued)

OTHER PUBLICATIONS

International Search Report & Written Opinion, PCT/US2009/055572, mailed Apr. 15, 2010.

(Continued)

*Primary Examiner* — Gregory Webb
(74) *Attorney, Agent, or Firm* — Kevin L. Daffer; Mollie E. Lettang; Daffer McDaniel LLP

(57) ABSTRACT

Methods and solutions for preventing the formation of metal particulate defect matter upon a substrate after plating processes are provided. In particular, solutions are provided which are free of oxidizing agents and include a non-metal pH adjusting agent in sufficient concentration such that the solution has a pH between approximately 7.5 and approximately 12.0. In some cases, a solution may include a chelating agent. In addition or alternatively, a solution may include at least two different types of complexing agents each offering a single point of attachment for binding metal ions via respectively different functional groups. In any case, at least one of the complexing agents or the chelating agent includes a non-amine or non-imine functional group. An embodiment of a method for processing a substrate includes plating a metal layer upon the substrate and subsequently exposing the substrate to a solution comprising the aforementioned make-up.

23 Claims, 1 Drawing Sheet

(56) References Cited

U.S. PATENT DOCUMENTS

| | | | | |
|---|---|---|---|---|
| 2005/0084615 | A1* | 4/2005 | Weidman et al. | 427/305 |
| 2005/0161338 | A1 | 7/2005 | Fang et al. | |
| 2005/0170650 | A1* | 8/2005 | Fang et al. | 438/689 |
| 2005/0181961 | A1 | 8/2005 | Misra et al. | |
| 2006/0246217 | A1* | 11/2006 | Weidman et al. | 427/99.5 |
| 2006/0252252 | A1* | 11/2006 | Zhu et al. | 438/618 |
| 2007/0066059 | A1 | 3/2007 | Chen et al. | |
| 2007/0197386 | A1 | 8/2007 | Diebold et al. | |
| 2008/0047592 | A1 | 2/2008 | Fisher et al. | |
| 2008/0206159 | A1 | 8/2008 | Tamarkin et al. | |
| 2009/0088511 | A1 | 4/2009 | Konno et al. | |

FOREIGN PATENT DOCUMENTS

| | | |
|---|---|---|
| KR | 10-2004-0106327 | 12/2004 |
| KR | 10-0685028 | 2/2007 |
| KR | 20080111268 | 12/2008 |
| WO | 2006/137663 | 12/2006 |
| WO | 2008/036559 | 3/2008 |

OTHER PUBLICATIONS

Office Action mailed May 5, 2011 for U.S. Appl. No. 12/206,509.
Final Office Action mailed Aug. 2, 2011 for U.S. Appl. No. 12/206,509.
Advisory Action mailed Nov. 3, 2011 for U.S. Appl. No. 12/206,509.

* cited by examiner

METHODS AND SOLUTIONS FOR PREVENTING THE FORMATION OF METAL PARTICULATE DEFECT MATTER UPON A SUBSTRATE AFTER A PLATING PROCESS

BACKGROUND OF THE INVENTION

1. Field of the Invention

This invention generally relates to methods and solutions for processing a substrate and, more specifically, to methods and solutions for preventing the formation of metal particulate defect matter upon a substrate after a plating deposition process.

2. Description of the Related Art

The following descriptions and examples are not admitted to be prior art by virtue of their inclusion within this section.

Unwanted particulate material and byproduct films often accumulate on substrates after plating deposition processes. As such, cleaning processes are often employed to remove the material. In general, the objective of cleaning processes is to provide the plated metal layer with a substantially smooth and planar surface. In addition or alternatively, the cleaning processes may serve to remove metallic particulate material and byproduct films from dielectric materials adjacent to a plated layer such that shorts and leakage current between metallic lines may be mitigated. Cleaning the surface of the dielectric materials may also advantageously increase the surface resistance of the dielectric materials and, as a result, the metallic lines may maintain breakdown voltages within design specifications.

A common technique for removing particulate matter from a substrate after a plating deposition process includes dosing the substrate with copious amounts of water. The technique, however, is generally not effective for removing all particulate matter or preventing the formation of byproduct films. In some cases, acids or strong bases (i.e., having a pH greater than 12.0) have been employed to enhance particulate matter removal after a plating deposition process. Acids and strong bases, however, cause corrosion of metallic films and, thus, such solutions may not be suitable for some applications. For example, as dimensions of integrated circuit components continue to decrease, even the slightest corrosion of a metallic layer or structure during the fabrication of an integrated circuit may become increasingly unacceptable. Furthermore, it has been discovered that metal particles and/or salts may still remain on a surface after applications of acids or strong bases in some cases.

An alternative approach to removing residual matter from a semiconductor surface after a plating deposition process is to apply a solution of hydroxylamine to a semiconductor topography. Similar solutions are used to remove photoresist from a semiconductor topography as well. Although such a technique has been found to be non-corrosive as well as effective for providing surfaces substantially free of particulate material and byproduct films, the use of hydroxylamine is undesirable due to its high cost, lack of availability, and extreme safety issues (e.g., hydroxylamine is prone to exploding upon heating and is an irritant to mucous membranes of humans).

As such, it would be advantageous to develop safe, feasible, cost-effective, and non-corrosive methods and solutions which effectively provide substrate surfaces that are substantially free of particulate material and byproduct films after a plating deposition process.

SUMMARY OF THE INVENTION

The problems outlined above may be in large part addressed by exposing a substrate to a non-corrosive solution configured to prevent the formation of metal particulate defect matter upon the substrate after a plating deposition process. The following are mere exemplary embodiments of methods and solutions, but are not to be construed in any way to limit the subject matter of the claims.

Embodiments of solutions for processing a substrate include a non-metal pH adjusting agent in sufficient concentration such that the solutions have a pH between approximately 7.5 and approximately 12.0. In addition, the solutions are free of oxidizing agents. In some cases, a solution may include a chelating agent having at least one non-amine or non-imine functional group. In addition or alternatively, a solution may include at least two different types of complexing agents each offering a single point of attachment for binding metal ions via respectively different functional groups. In such embodiments, at least one of the two different types of complexing agents may include a non-amine or non-imine functional group. An embodiment of a method for processing a substrate includes plating a metal layer upon a substrate and subsequently exposing the metal layer to a solution comprising the aforementioned make-up.

BRIEF DESCRIPTION OF THE DRAWINGS

Other objects and advantages of the invention will become apparent upon reading the following detailed description and upon reference to the accompanying drawings in which.

Figure 1:
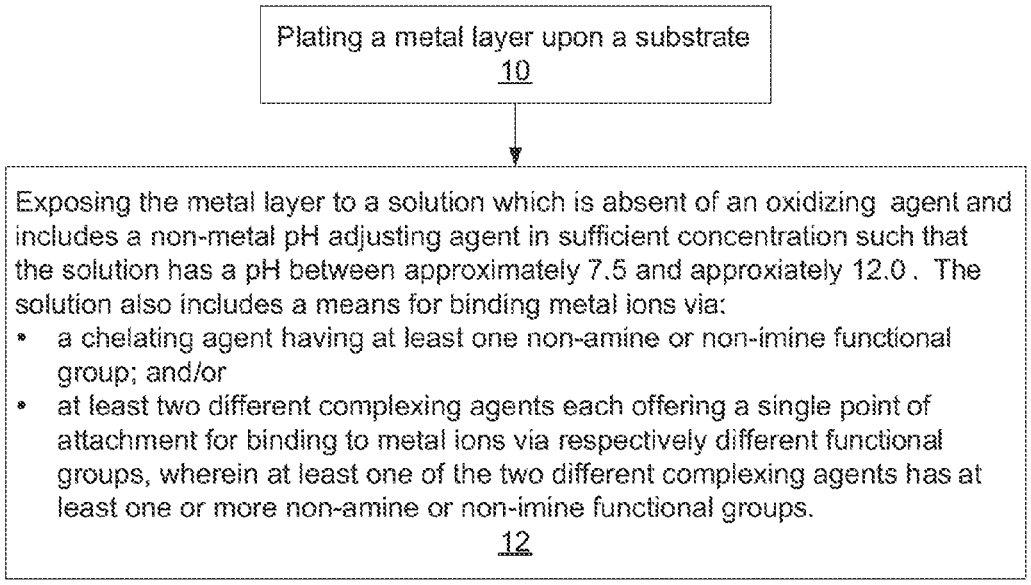
FIG. 1 depicts a flowchart of an exemplary method for processing a substrate.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Figure 2:
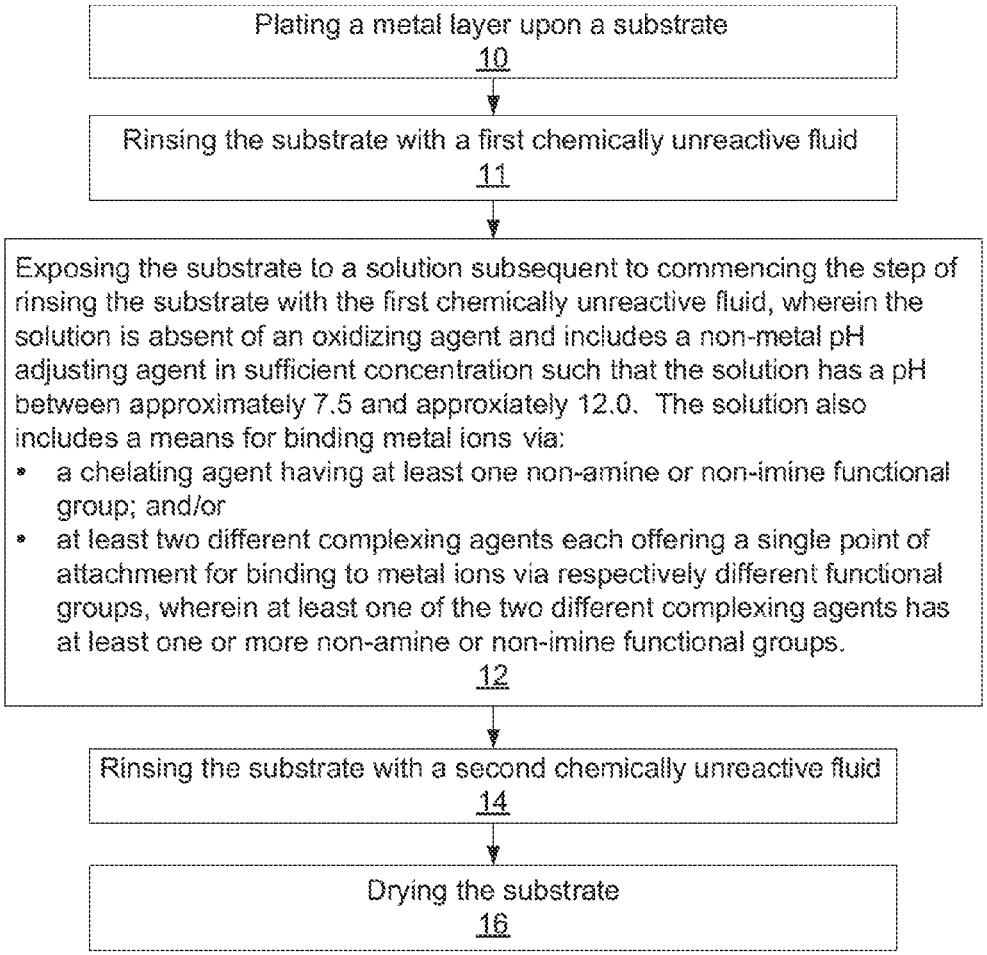
FIG. 2 depicts a flowchart of another exemplary method for processing a substrate.

Turning now to the drawings, exemplary embodiments of methods for processing a substrate and particularly exemplary methods for preventing the formation of metal particulate defect matter upon a substrate after a plating deposition process are illustrated in FIGS. 1 and 2. Specific details and various embodiments of such methods and the solutions used are provided below in reference to the figures. It is noted that the methods described herein are not necessarily limited to the flowcharts depicted in FIGS. 1 and 2. In particular, the methods described herein may include additional steps not shown in FIGS. 1 and 2 for the fabrication of an integrated circuit, including steps performed prior to, intermediate to, and/or after the steps shown in FIGS. 1 and 2.

As shown in block 10 of FIG. 1, the methods described herein include plating a metal layer upon a substrate. The plating process may include an electroplating process or an electroless plating process and the metal layer may include any composition that may be plated by such processes, including but not limited to cobalt, phosphorus, boron, tungsten, chromium, molybdenum, nickel, palladium, rhodium, ruthenium, copper, and alloys thereof. In addition, the plating process may be a blanket deposition or may be a selective deposition. In embodiments in which the plating process is a selective deposition, the resulting substrate may be referred to as "a substrate with a patterned metal layout" or more simply, a "patterned substrate". In such cases, the process discussed in reference to block 12 of exposing the metal layer to the described solution may include exposing adjacent portions of the substrate as well.

The thickness of the metal layer plated in reference to block 10 may generally depend on the design specifications of the device being fabricated and, thus may vary widely. A general range may include but is not limited to approximately 5 angstroms to approximately 1000 angstroms. Although their applications are not necessarily so restricted, plating processes are particularly employed in semiconductor fabrication for depositing liner and/or cap layers, which are typically relatively thin (i.e., on the order of 100 angstroms or less and, most recently, on the order of 50 angstroms or less). To accommodate such a bias, the solutions used for preventing the formation of metal particulate defect matter in the methods described herein may be particularly suited to accommodate thin plated layers as set forth in more detail below (i.e., layers having thicknesses 100 angstroms or less and, in some cases, layers having thicknesses 50 angstroms or less).

Regardless of the plating process used as well as the composition, layout, and the thickness of the metal layer, the methods described herein include exposing the plated metal layer and, in some cases, adjacent portions of the substrate to a solution as shown in block 12 of FIG. 1. The solution includes a non-metal pH adjusting agent in sufficient concentration such that the solution has a pH between approximately 7.5 and approximately 12.0. In addition, the solution is free of an oxidizing agent. As set forth in more detail below, in some cases, the solution may include a chelating agent having at least one non-amine or non-imine functional group. In addition or alternatively, the solution may include at least two different types of complexing agents each offering a single point of attachment for binding metal ions via respectively different functional groups. In such latter embodiments, at least one of the two different types of complexing agents may include a non-amine or non-inline functional group. It is noted that the reference of different "types" of complexing agents as used herein refers to complexing agents of different chemical configurations.

It is hypothesized that the solution embodiments outlined in block 12 may generally complex (i.e., chelate, sequester, stabilize, etc.) metal ions suspended in fluid above the surface of the substrate after the plating process. The fluid may be residual amounts of the plating solution used in block 10 or, as described in more detail below with respect to FIG. 2, may be residual amounts of a substantially diluted version of the plating solution due to the incorporation of a rinse of the substrate with a chemically non-reactive fluid after the plating process. In either case, complexing the metal ions will substantially lower their reduction potential and, in effect, reduce their likelihood to form metal particulate defect matter and precipitate on the substrate. As such, it is theorized the methods described herein primarily serve to prevent the formation of metal particulate defect matter rather than remove metal particulate defect matter from a substrate. This is a key distinction over many conventional techniques which concentrate on the corrosiveness and/or oxidizing ability of solutions to remove defect matter. The term "metal particulate defect matter" as used herein may generally refer to any particulate matter including a metallic element.

As used herein, the term "complexing agent" refers to a ligand (i.e., a molecule or an ion) that binds to a metal ion to form a complex, using one or more points of attachment. It is noted that the term encompasses the narrower classification of a "chelating agent," which refers to a ligand (i.e., a molecule or an ion) that binds to a metal ion to form a complex, using multiple points of attachment. It was discovered during the development of the methods and solutions described herein that a solution having a chelating agent with at least one non-amine or non-imine functional group applied at a pH between approximately 7.5 and approximately 12.0 and a temperature between approximately 15° C. and approximately 50° C. effectively eliminates the formation of metal particulate defect matter on a substrate after a plating process. Furthermore, it was discovered that such solutions may be effective regardless of whether the chelating agents incorporated therein offer the same or different functional groups for binding metal ions. Moreover, it was discovered that a solution applied at a pH and a temperature within the ranges noted above and having at least two different types of complexing agents each offering a single point of attachment for binding metal ions via respectively different functional groups effectively eliminates the formation of metal particulate defect matter on a substrate after a plating process as well. In such cases, at least one of the two different complexing agents includes a non-amine or non-imine functional group.

On the contrary, however, a solution with a pH and a temperature within the same ranges and including different types of complexing agents each offering a single point of attachment for binding metal ions via the same functional group does not effectively eliminate the formation of metal particulate defect matter on a substrate after a plating process. In addition, a solution comprising a single type of complexing agent offering a single point of attachment for binding metal ions does not effectively eliminate the formation of metal particulate defect matter on a substrate after a plating process. Such contrary results were found particularly germane but not necessarily limited to preventing the formation of metal particulate defect matter consisting essentially of one or more metal elements.

For instance, it was found that a solution of ammonia adjusted to a pH of approximately 10.0 was not effective for preventing the formation of metallic particulate defect matter on a substrate after a plating process. In such a case, ammonia served as the only complexing agent in the solution and, by its nature, offered a single point of attachment for binding metal ions. On the contrary, however, dissolving a compound of ammonium citrate into deionized water and adjusting it to a pH of approximately 10.0, for example, was effective for preventing the formation of metallic particulate defect matter on a substrate after a plating process. In such cases, ammonia and citrate ions served as the complexing agents in the solution. By their nature, citrate ions each offer three distinct points of attachment for binding metal ions and, thus, are specifically categorized as chelators. Although it was found that ammonia alone in a solution was not effective for preventing the formation of metallic particulate defect matter on a substrate after a plating process, it is believed that ammonia aids in such prevention and, as such, ammonia and citrate ions in a solution may collectively serve to bind metal ions. Other exemplary compounds having one or more complexing agents (i.e., one or more chelating agents and/or at least two different complexing agents offering single points of attachment) which were found to be effective for preventing the formation of metallic particulate defect matter on a substrate after a plating process are shown in Table 1 below.

In general, the complexing agent/s in the solutions described herein (i.e., solutions including one or more chelating agents and/or at least two different complexing agents offering single points of attachment) may be derived from dissolving one or more compounds comprising the complexing agent/s into deionized water. In some embodiments, a plurality of complexing agents may be derived from dissolving a single compound having multiple complexing agents into deionized water. In other embodiments, a plurality of complexing agents may be derived from multiple compounds each having one or more of the complexing agents. In yet other cases, a single chelating agent may be derived from dissolving a single compound having the single chelating agent into deionized water. The term "compound," as used herein, may generally refer to a material formed from elements chemically combined in definite portions by mass. Table 1 offers a list of some exemplary compounds for supplying complexing agent's to a solution. The methods and solutions described herein, however, are not necessarily so restricted. In particular, other compounds offering the complexing agents listed in Table 1 and/or other complexing agents may be considered. Furthermore, although Table 1 specifically lists compounds offering chelating agents and, in some cases, further offering complexing agents having a single point of attachment for binding metal ions, other compounds may be considered which solely offer complexing agents having single points of attachment.

TABLE 1

Exemplary Compounds for Supplying Complexing Agent/s to the Solution

| Compound Added to Solution | Complexing Agent/s Supplied by the Compound |
|---|---|
| Ammonium Citrate | Ammonia, Citrate ion |
| Methylamine Citrate | Methylamine, Citrate ion |
| Dimethylamine Citrate | Dimethylamine, Citrate ion |
| EDTA | Amine and Carboxylate groups |
| HEDTA | Amine and Carboxylate groups |
| Citric Acid | Citrate ion |
| L-Serine | Amine and Carboxylate groups |

As noted above, at least one of the complexing agent's in the solutions described herein includes a non-amine or non-imine functional group. For example, the solutions may include citrate or carboxylate ions as noted in Table 1. Other complexing agents which do not have an amine or imine functional group may also be considered. The distinction of having at least one non-amine or non-imine functional group, however, does not necessarily exclude the solutions from having complexing agent/s with amine and/or imine functional groups as set forth in the examples in Table 1. For example, a solution including methylamine and citrate ions as complexing agents was found to be effective for preventing the formation of metallic particulate defect matter on a substrate after a plating process. Other complexing agents having amine or imine functional groups may be considered as well, such as but not limited to amino acids, ammonia, and dimethylamine as shown in Table 1. In any case, the concentration of the complexing agent/s in the solutions described herein may be between approximately 0.1 g/L and approximately 5.0 g/L and, in some embodiments, more specifically between approximately 1.0 g/L and approximately 2.0 g/L. Smaller or larger concentrations, however, may be considered.

In addition to having one or more complexing agents with the aforementioned limitations, it was found during the development of the methods and solutions described herein that prevention of metal particulate defect matter upon a substrate after a plating process was more effective if the solution contained at least one additional chemical species of ammonia, an amine-based compound, or an imine-based compound. For example, the preparation of a solution may include mixing ammonium citrate and ammonia (or alternatively an amine compound or an imine compound) into deionized water. In such an example, the solution includes ammonium derived from different sources. Other combinations of the compounds may be considered as well, including but not limited to ammonia, an amine-based compound, or an imine-based compound mixed with the compounds noted above for providing complexing agents to the solutions described herein.

It is theorized that the addition of ammonia, an amine-based compound, and/or an imine-based compound enhances the stability of non-amine or non-imine complexing agents and, thus, is effective for stabilizing the binding of metal ions thereto. Furthermore, the inclusion of ammonia, an amine-based compound, and/or an imine-based compound may serve to adjust the pH of the solution to a desired range and, thus, may serve as a non-metal pH adjusting agent. In some cases, such non-metal pH adjusting agents may be particularly suitable for solutions including ethylenediaminetetraacetic acid (commonly referred to as "EDTA"), and N-(2-hydroxyethyl)ethylenediamine triacetic acid (commonly referred to as "HEDTA") since such compounds are acidic and the solutions described herein are preferably basic, specifically having a pH between approximately 7.5 and approximately 12.0 as described in more detail below. Moreover, it is noted that the additional chemical species of ammonia, an amine-based compound, or an imine-based compound may further serve to supply complexing agent/s to a solution.

As noted above, the solutions described herein may include a non-metal pH adjusting agent in sufficient concentration such that the solution has a pH between approximately 7.5 and approximately 12.0. In some embodiments, the pH of the solutions may be specifically adjusted to be between approximately 9.0 and approximately 11.0 and even more specifically between approximately 9.5 and approximately 10.5. Such ranges are specifically selected to avoid excessive etching of the plated layer. In particular, it has been found that strong bases (i.e., having a pH greater than approximately 12.0) and acids, even mild acids having a pH between approximately 6.0 and approximately 7.0, are more corrosive to a metal layer than a solution having a pH between approximately 7.5 and approximately 12.0. Such pH specificity may be of particular importance with thin plated layers such that a solution does not etch through a layer upon exposure to a substrate. Thin layers, as referenced herein, may generally refer to layers having thicknesses of approximately 100 angstroms or less and, more specifically, thicknesses of approximately 50 angstroms or less. It is noted that although the aforementioned pH range is considered mildly basic, a solution at such a pH range may serve to slightly etch the metal layer, which may be advantageous in some embodiments for removing defect or residual matter formed thereon.

In general, it is advantageous to avoid the oxidation of metal lines on a semiconductor topography after a plating process. Consequently, the solutions described herein do not include oxidizing agents, such as hydrogen peroxide, for example. In some cases, the solutions described herein may specifically include compounds having antioxidant properties (a.k.a., "antioxidant agents"), such as but not limited to oxygen scavengers and/or corrosion inhibitors. Some exemplary oxygen scavengers include but are not limited to ascorbic acid and sulfite. A concentration of an antioxidant agent in the solution described herein may generally be between approximately 0.1 g/L and approximately 5.0 g/L and, in some embodiments, more specifically between approximately 1.0 g/L and approximately 3.0 g/L. Larger or smaller concentrations, however, may be considered. An additional or alternative manner to avoid oxidation of metal lines on a semiconductor topography after a plating process is to introduce a purge gas which is substantially free of oxygen (such as less than approximately 1% of oxygen) (e.g., nitrogen) into the process chamber comprising the substrate. The purge gas is preferably introduced before the termination of the plating process.

Regardless of the manner in which the oxidation of metal lines is prevented, the solutions described herein may, in some embodiments, include one or more additional components. For instance, the solutions may, in some cases, include a surfactant to improve the hydrophilicity of a substrate's surface. A concentration of the surfactant may generally be between approximately 5 ppm and approximately 500 ppm and, in some embodiments, more specifically between approximately 20 ppm and approximately 200 ppm. Larger or smaller concentrations, however, may be considered. Exemplary embodiments which include surfactants in solutions may be of particular benefit are those that have substrates including materials with low dielectric constant values exposed in addition to a plated metal layer. Such substrates may be referred to as "patterned substrates" as previously discussed. In addition or alternatively, the solutions described herein may include solvents for solubilizing organic contaminants, such as but not limited to butoxyethanol.

In general, the solutions described herein may be applied at a temperature between approximately 15° C. and approximately 50° C. Such a temperature range is selected such that a substrate may be cooled during exposure to the solutions or may avoid being heated from a cooled state. In some cases, the temperature range may be particularly suitable in which a metal layer is previously plated via electroless deposition techniques. In particular, electroless deposition techniques depend upon elevated temperatures (among other things) to facilitate plating. As such, decreasing the temperature of a substrate or avoiding a temperature increase of a substrate may further insure residual plating does not occur to form metallic particulate defect matter on the surface of the substrate. Such protection may be particularly needed if a solution is applied to the substrate directly after the plating process, but may also be needed if a solution is applied after a delay and/or after an application of a chemically inert rinse after the plating process as described in more detail below. It is noted, however, avoiding high temperatures is of less concern in the latter embodiments. As noted above, the solutions described herein may, in some embodiments, be applied at room temperature (e.g., temperatures between approximately 20° C. and approximately 30° C.). Such a temperature range may be advantageous for not having to heat or cool the solution.

An exemplary set of process steps for preventing the formation of metallic particulate defect matter upon a substrate after a plating process are outlined in the flowchart depicted in FIG. 2. In some embodiments, the set of process steps may be a set of steps which are successively performed without any intermediate processing steps (i.e., performed sequentially and without interruption of other steps used to treat the substrate). Such a scenario is specifically described in more detail below. As with the selection of process parameters of the solutions described herein (pH, temperature, etc.), it was found during the developments of the methods described herein that the set of process steps shown in FIG. 2 successively performed may be specifically suitable to an electroless plating process of a relatively thin metal layer. However, it is contemplated that the method depicted in FIG. 2 may be modified with one or more steps intermediate to those shown and, thus, the methods described herein are not necessarily restricted to the depiction of FIG. 2.

As shown in FIG. 2, the method may include plating a metal layer upon a substrate as denoted in block 10. Such a process may be substantially similar to block 10 described in reference to FIG. 1 and, therefore, the description provided above is referenced and not reiterated for the sake of brevity. Subsequent to depositing a metal layer via a plating process, the method may include rinsing the substrate with a first chemically non-reactive fluid as denoted in block 11. The first chemically non-reactive fluid may include deionized water and, in some cases, may consist essentially of deionized water, but other fluids considered chemically non-reactive with the materials of the substrate may be used. The objective of the rinse with the first chemically non-reactive fluid may be to substantially remove and dilute any residual plating solution on the substrate. In some cases, the process may be further configured to rinse the interior components of the process chamber in which the substrate resides and, thus, may serve to substantially remove and dilute any plating solution arranged on such components.

The amount of time the substrate is rinsed with the first chemically non-reactive fluid may vary, but an exemplary amount of time may generally be between approximately 5 seconds and approximately 1 minute and, in some embodiments, approximately 30 seconds. Longer times may insure the plating solution upon the substrate is sufficiently removed and/or diluted, but a contradicting objective may be to conserve the amount of fluid used and/or decrease processing time. In any case, the first chemically non-reactive fluid may generally be introduced at a temperature between approximately 15° C. and approximately 50° C. and, in some embodiments, at room temperature (e.g., between approximately 20° C. and approximately 30° C.). Since most plating processes are conducted at temperatures above approximately 70° C. and more generally between approximately 75° C. and approximately 90° C., the process of rinsing the substrate with the first chemically non-reactive fluid may, in some embodiments, further serve to reduce the temperature of the substrate. Such an effort may be particularly advantageous when the metal layer is plated via electroless plating, since a drop in temperature may substantially terminate an electroless plating process.

In some embodiments, the process of rinsing the substrate with the first chemically non-reactive fluid may be delayed slightly from the termination of plating the metal layer. Such a delay may be intentional or may be restricted by the capabilities of the process chamber to change processing modes. In either case, the delay may additionally or alternatively serve to reduce the temperature of the substrate such that a plating deposition process is terminated (particularly if an electroless plating process is used). The delay may be any amount of time, but an exemplary amount of delay may generally be between less than 1 minute and, more generally, less than 20 seconds. It is noted that a delay between the processes denoted in blocks 11 and 12 or between any other process steps of the method described in reference to FIG. 2 does not warrant a process for treating the substrate and, thus, delays do not read as interruptions to the succession of the steps referenced in FIG. 2.

As shown in FIG. 2, the method may continue to block 12 in which the substrate is exposed to a solution including a non-metal pH adjusting agent in sufficient concentration such that the solution has a pH between approximately 7.5 and approximately 12.0. In addition, the solution is free of an oxidizing agent. As shown in block 12, in some cases, the solution may include a chelating agent having at least one non-amine or non-imine functional group. In addition or alternatively, the solution may include at least two different types of complexing agents each offering a single point of attachment for binding metal ions via respectively different functional groups. In such latter embodiments, at least one of the two different types of complexing agents may include a non-amine or non-imine functional group. The exposure of the substrate to the solution may be substantially similar to the process described for block 12 in FIG. 1 and, consequently, the description provided above is referenced and not reiterated for the sake of brevity.

In some embodiments, block 12 may include adding predetermined proportions of the active ingredients of the solution into the flow of the rinse fluid described in reference to block 11. In particular, predetermined portions of one or more compounds with one or more complexing agents, a non-metal pH adjusting agent, and any of the other solution components described above may be added to the flow of the first chemically non-reactive fluid. It is noted that the "predetermined portions" of the components may be determined based on the concentrations of the solution and the flowrate of the first chemically non-reactive fluid, computations of which would be generally be familiar to those skilled in the art. In general, adding the solution components into the flow of the first chemically non-reactive fluid may insure there is no delay between the processes of blocks 11 and 12. In other embodiments, however, the solution introduced at block 12 may be prepared as a separate solution from the first chemically non-reactive fluid. In such cases, the process of block 12 may be applied immediately after or may be delayed from the process of block 11. In any embodiment, the flow rate of the solution may vary, but an exemplary flow rate range may be between approximately 200 ml/minute and approximately 1 L/min and, in some cases, around approximately 400 ml/min. Shorter rinse times (e.g., less than approximately 1 minute) may be considered more advantageous to minimize the amount of solution used as well as to enhance throughput.

Continuing with the method depicted in FIG. 2, the substrate is rinsed with a second chemically non-reactive fluid after the exposure to the solution is complete as shown in block 14. As with the first chemically non-reactive fluid, the second chemically non-reactive fluid may include deionized water and, in some cases, may consist essentially of deionized water, but other fluids considered chemically non-reactive with the materials of the substrate may be used. In some cases, the first and second chemically non-reactive fluids may be the same fluids or, alternatively, they may be different fluids. The objective of the rinse with the second chemically non-reactive fluid may be to substantially remove and dilute any remnants of the solution applied during the process referenced in block 12. Similar to the process of block 11, the process of block 14 may be further configured to rinse the interior components of the process chamber in which the substrate resides and, thus, may serve to substantially remove and dilute any residual solution arranged on such components. The amount of time the substrate is rinsed with the second chemically non-reactive fluid may vary, but an exemplary amount of time may generally be less than approximately 1 minute and, in some embodiments, between approximately 5 and approximately 10 seconds. Longer times may insure the solution upon the substrate is sufficiently removed and/or diluted, but a contradicting objective may be to conserve the amount of fluid used and/or decrease processing time.

Similar to the process of block 11, the second chemically non-reactive fluid may be introduced at a temperature between approximately 15° C. and approximately 50° C. and, in some embodiments, specifically at room temperature (e.g., between approximately 20° C. and approximately 30° C.) to avoid having to heat or cool the fluid. In general, the process of rinsing the substrate with the second chemically non-reactive fluid may be either applied immediately after the termination of exposing the solution referenced in block 12 to the substrate or may be delayed slightly relative thereto. In cases in which the solution referenced in block 12 is introduced into the flow of the first chemically non-reactive fluid, the process of block 14 may, in some embodiments, include terminating the introduction of the solution's active components such that only the chemically non-reactive fluid is still flowing (i.e., as the second chemically non-reactive fluid). In other embodiments, the second chemically non-reactive fluid may be introduced to the substrate as a separate distinct fluid. In any case, the method may continue to block 16 in which the substrate is dried subsequent to the termination of rinsing the substrate with the second chemically non-reactive fluid. Any drying technique known to those skilled in the art may be used.

It will be appreciated to those skilled in the art having the benefit of this disclosure that this invention is believed to provide a methods and solutions for preventing the formation of metal particulate defect matter upon a substrate. Further modifications and alternative embodiments of various aspects of the invention will be apparent to those skilled in the art in view of this description. For example, although the methods and systems provided herein are described in reference to preventing the formation of metal particulate defect matter after a plating deposition process, the methods and solutions are not necessarily so restricted. In particular, the methods and solutions described herein may alternatively be used after any wet deposition process of metal film. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed:

1. A method for processing a substrate, comprising:

plating a metal layer upon a substrate;

rinsing the substrate substantially solely with a chemically non-reactive fluid to remove and/or dilute a plating deposition fluid residing thereon used for the step of plating the metal layer, wherein the method is void of steps for treating the substrate between the step of plating the metal layer upon the substrate and the step of rinsing the substrate with the chemically non-reactive fluid; and exposing the substrate topography rinsed with the chemically non-reactive fluid to a solution which is absent of an oxidizing agent and comprises a non-metal pH adjusting agent in sufficient concentration such that the solution has a pH between approximately 7.5 and approximately 12.0, wherein the solution further comprises a means for binding metal ions via:

a chelating agent having at least one non-amine or non-imine functional group; and/or at least two different types of complexing agents each offering a single point of attachment for binding metal ions via respectively different functional groups, wherein at least one of the two different complexing agents has at least one non-amine or non-imine functional group.

2. The method of claim 1, wherein the chelating agent and the different types of complexing agents are selected from a group consisting of amino acid, ammonia, citrate ions, methylamine, dimethylamine, and carboxylate ions.

3. The method of claim 1, wherein the non-metal pH adjusting agent is selected from a group consisting of ammonia, amines and imines.

4. The method of claim 1, wherein the solution further comprises an antioxidizing agent.

5. The method of claim 1, wherein the step of rinsing the substrate comprises introducing the chemically non-reactive fluid to the substrate at a temperature less than approximately 50° C.

6. The method of claim 1, wherein the step of exposing the substrate topography to the solution comprises introducing the solution to the substrate at a temperature less than approximately 50° C.

7. The method of claim 1, wherein the step of exposing the substrate topography to the solution comprises introducing the non-metal pH adjusting agent and the means for binding metal ions into a flow of the chemically non-reactive fluid being supplied to the substrate.

8. The method of claim 1, further comprising rinsing the substrate topography with a chemically non-reactive fluid subsequent to the step of exposing the substrate topography to the solution.

9. The method of claim 1, wherein the step of plating the metal layer comprises electrolessly plating the metal layer.

10. The method of claim 1, further comprising introducing a purge gas substantially free of oxygen into a process chamber comprising the substrate prior to and/or during the step of exposing the substrate topography to the solution.

11. A method for processing a substrate, comprising:

plating a metal layer upon a substrate; and exposing the substrate and a plating deposition fluid residing thereon used for the step of plating the metal layer to a solution for preventing formation of metal particulate matter on the substrate, wherein the solution is absent of an oxidizing agent and comprises:

a non-metal pH adjusting agent in sufficient concentration such that the solution has a pH between approximately 7.5 and approximately 12.0;

an antioxidizing agent; and a means for binding metal ions via:

a chelating agent having at least one non-amine or non-imine functional group; and/or at least two different types of complexing agents each offering a single point of attachment for binding metal ions via respectively different functional groups, wherein at least one of the two different complexing agents has at least one non-amine or non-imine functional group.

12. The method of claim 11, wherein the chelating agent and the different types of complexing agents are selected from a group consisting of amino acid, ammonia, citrate ions, methylamine, dimethylamine, and carboxylate ions.

13. The method of claim 11, wherein the non-metal pH adjusting agent is selected from a group consisting of ammonia, amines and imines.

14. The method of claim 11, wherein the step of plating the metal layer comprises introducing the plating deposition fluid to the substrate at a temperature greater than approximately 70° C., and wherein the step of exposing the substrate and the plating deposition fluid residing thereon to the solution comprises introducing the solution to the substrate at a temperature less than approximately 50° C.

15. The method of claim 14, wherein the step of exposing the substrate and the plating deposition fluid residing thereon to the solution comprises introducing the solution to the substrate at a temperature less than approximately 30° C.

16. The method of claim 11, wherein the step of plating the metal layer comprises electrolessly plating the metal layer.

17. The method of claim 11, wherein the step of exposing the substrate and the plating deposition fluid residing thereon to the solution comprises supplying the non-metal pH adjusting agent, the antioxidizing agent and the means for binding metal ions into a flow of a chemically non-reactive fluid being supplied to the substrate.

18. The method of claim 17, further comprising terminating the supply of the non-metal pH adjusting agent, the antioxidizing agent and the means for binding metal ions into the flow of the chemically non-reactive fluid such that the substrate is rinsed with the chemically non-reactive fluid subsequent to the step of exposing the substrate and the plating deposition fluid residing thereon to the solution.

19. The method of claim 11, further comprising introducing a purge gas substantially free of oxygen into a process chamber comprising the substrate prior to and/or during the step of exposing the substrate and the plating deposition fluid residing thereon to the solution.

20. The method of claim 11, further comprising rinsing the substrate substantially solely with a chemically non-reactive fluid to dilute the plating deposition fluid residing on the substrate prior to exposing the substrate to the solution.

21. A method for processing a substrate, comprising:

introducing a plating deposition fluid to a substrate at a temperature greater than approximately 70° C.;

plating a metal layer upon a substrate via the plating deposition fluid; and exposing the plated metal layer and surrounding surfaces of the substrate to a solution for preventing formation of metal particulate matter on the substrate, wherein the step of exposing the plated metal layer and surrounding surfaces of the substrate comprises introducing the solution to the substrate at a temperature less than approximately 50° C., and wherein the solution is absent of an oxidizing agent and comprises:

a non-metal pH adjusting agent in sufficient concentration such that the solution has a pH between approximately 7.5 and approximately 12.0; and a means for binding metal ions via:

a chelating agent having at least one non-amine or non-imine functional group; and/or at least two different types of complexing agents each offering a single point of attachment for binding metal ions via respectively different functional groups, wherein at least one of the two different complexing agents has at least one non-amine or non-imine functional group.

22. The method of claim 21, wherein the rinse solution further comprises an antioxidizing agent.

23. The method of claim 21, further comprising rinsing the plated metal layer and surrounding surfaces of the substrate substantially solely with a chemically non-reactive fluid prior to exposing the plated metal layer and the surrounding surfaces of the substrate to the solution.

* * * * *